US009089754B1

(12) United States Patent
Chen

(10) Patent No.: US 9,089,754 B1
(45) Date of Patent: Jul. 28, 2015

(54) GOLF SWING/PUTTING TRAINER

(71) Applicant: Yung-Shen Chen, Taipei (TW)

(72) Inventor: Yung-Shen Chen, Taipei (TW)

( * ) Notice: Subject to any disclaimer, the term of this patent is extended or adjusted under 35 U.S.C. 154(b) by 0 days.

(21) Appl. No.: 14/314,973

(22) Filed: Jun. 25, 2014

(51) Int. Cl.
*A63B 69/36* (2006.01)

(52) U.S. Cl.
CPC ..... *A63B 69/36* (2013.01); *A63B 69/3632* (2013.01); *A63B 69/3685* (2013.01)

(58) Field of Classification Search
USPC ..... 473/206, 212, 213, 219, 226, 227, 238, 473/275, 276
See application file for complete search history.

(56) References Cited

U.S. PATENT DOCUMENTS

| | | | | |
|---|---|---|---|---|
| 2,737,432 | A | 3/1956 | Jenks | |
| 3,415,523 | A | 12/1968 | Boldt | |
| 3,429,571 | A | 2/1969 | Abel, Jr. | |
| 3,489,416 | A | 1/1970 | Mark | |
| 3,614,108 | A | 10/1971 | Garten | |
| 3,926,430 | A | 12/1975 | Good, Jr. | |
| 4,896,887 | A | 1/1990 | Cable | |
| 5,125,882 | A | 6/1992 | La Mothe et al. | |
| 5,156,401 | A * | 10/1992 | Hodgkiss | 473/227 |
| 5,531,446 | A * | 7/1996 | Scheie et al. | 473/227 |
| 5,902,189 | A | 5/1999 | Schultz | |
| 6,855,065 | B1 | 2/2005 | Hamilton | |
| 7,033,282 | B1 * | 4/2006 | Flood | 473/227 |
| 7,033,284 | B2 * | 4/2006 | Yoshimura | 473/276 |
| 7,585,228 | B2 | 9/2009 | McFarlin et al. | |
| 7,942,755 | B2 * | 5/2011 | Diley | 473/227 |

* cited by examiner

*Primary Examiner* — Nini Legesse
(74) *Attorney, Agent, or Firm* — Pai Patent & Trademark Law Firm; Chao-Chang David Pai

(57) ABSTRACT

A golf swing/putting trainer includes a support member including a body shaped like a plate or shaft and having a supporting wall for stopping against the user's body, and a handle including a shaft connected at one end thereof to the center of the body of the support member and having a hand-hold portion for holding by the user's both hands. Thus, the user can hold the handle with the two hands to abut the supporting wall of the support member against the abdomen, and then twist the waist to practice the backswing and swing actions. Alternatively, the user can hold the handle with the two hands and attach the two lower arms to the two bearing portions of the support member to practice the putting action.

13 Claims, 8 Drawing Sheets

GOLF SWING/PUTTING TRAINER

BACKGROUND OF THE INVENTION (a) Field of the Invention

The present invention relates to a golf training aids and more particularly to a golf training system, which helps the user practice the backswing and swing actions as well as the putting action.

(b) Description of the Prior Art

Golf is a special ball sport. Golf posture and movement very emphasize the stability of body rotation. Sometimes, it needs to move the waist in swinging the body so as to further move the hands and the club in driving the ball. When performing a backswing action, the player must not open the elbows of the hands while maintaining club stability and keeping the face of the club head at the correct angle. Hence, one needs to frequently practice coordinated movement and consistency in swinging. Further, putting action is also a standard and stable operation of inertia. In order to maintain the stability of the club and hitting point, frequent practice is necessary.

Many golf swing training designs and aids have been created. Some large scale golf practice apparatuses are disclosed in U.S. Pat. No. 2,737,432; U.S. Pat. No. 3,415,523; U.S. Pat. No. 3,429,571; and U.S. Pat. No. 3,489,416. However, the application of these large scale golf practice apparatuses is restricted by the field, space and fund, and therefore is not practical for home use or for training anywhere and anytime when desired. Some medium scale golf practice apparatuses are disclosed in U.S. Pat. No. 3,614,108; U.S. Pat. No. 3,926,430; U.S. Pat. No. 5,125,882; U.S. Pat. No. 7,585,228; and U.S. Pat. No. 6,855,065. However, these medium scale golf practice apparatuses must be used at selected places.

Further, there are certain small golf practice apparatuses suitable for training anywhere and anytime. For example, some small golf practice apparatuses are adapted for training to avoid opening the arms by using straps to keep the arms in place. Exemplars of this design are disclosed in U.S. Pat. No. 4,896,887; U.S. Pat. No. 5,902,189. Some others are designed to provide a support, allocator or ball for setting between the arms. Exemplars of this design are disclosed in U.S. Pat. No. 6,176,790; U.S. Pat. No. 7,758,437; U.S. Pat. No. 5,145,179; U.S. Pat. No. 5,203,567; U.S. Pat. No. 5,711,716; US590462; U.S. Pat. No. 7,033,282; U.S. Pat. No. 7,033,284; U.S. Pat. No. 8,177,655; and U.S. Pat. No. 8,460,121. However, these conventional golf practice apparatuses are simply designed for correcting the arms, but not capable of helping the user train the twisting of the waist to move the arms in driving the ball. In particular, the swing action emphasizes the twisting of the waist.

SUMMARY OF THE INVENTION

The present invention has been accomplished under the circumstances in view. It is therefore the main object of the present invention to provide a golf swing/putting trainer, which provides a handle for holding by the user's hands and a support member for stopping against the user's abdomen to keep the user's hands in the correct posture so that the user can practice swing or backswing accurately.

To achieve this and other objects of the present invention, a golf swing/putting trainer in accordance with the present invention comprises a support member that comprises a body shaped like a plate or shaft and has a supporting wall for stopping against the user's body, and a handle that comprises a shaft connected with one end thereof to the center of the body of the support member and has a handhold portion for holding by the user's both hands. Thus, the user can hold the handle with the two hands to abut the supporting wall of the support member against the abdomen, and then twist the waist to practice the backswing and swing actions.

Further, the body of the support member comprises two bearing portions respectively located at two opposite ends thereof for stopping against the user's arms. The bearing portions are inwardly curved bearing edges respectively located at two opposite ends of the body of the support member. Thus, the user can hold the handle with the two hands, and then attach the two lower arms to the two bearing portions of the support member to practice the putting action.

Thus, the user can use the golf swing/putting trainer to practice golf driving anywhere anytime. By repeatedly training the waist and the arms to practice swinging and backswinging, the user can show the optimal posture and movement in the actual swing play. By repeatedly training the arms to practice the putting action, the user can show the optimal posture and movement in the actual putting play. Further, the handle can be made collapsible. When not in use, the support member and the handle can be detached from each other to facilitate carrying and storage.

Other advantages and features of the present invention will be fully understood by reference to the following specification in conjunction with the accompanying drawings, in which like reference characters denote like components of structure.

DETAILED DESCRIPTION OF THE PREFERRED EMBODIMENTS

Figure 1:
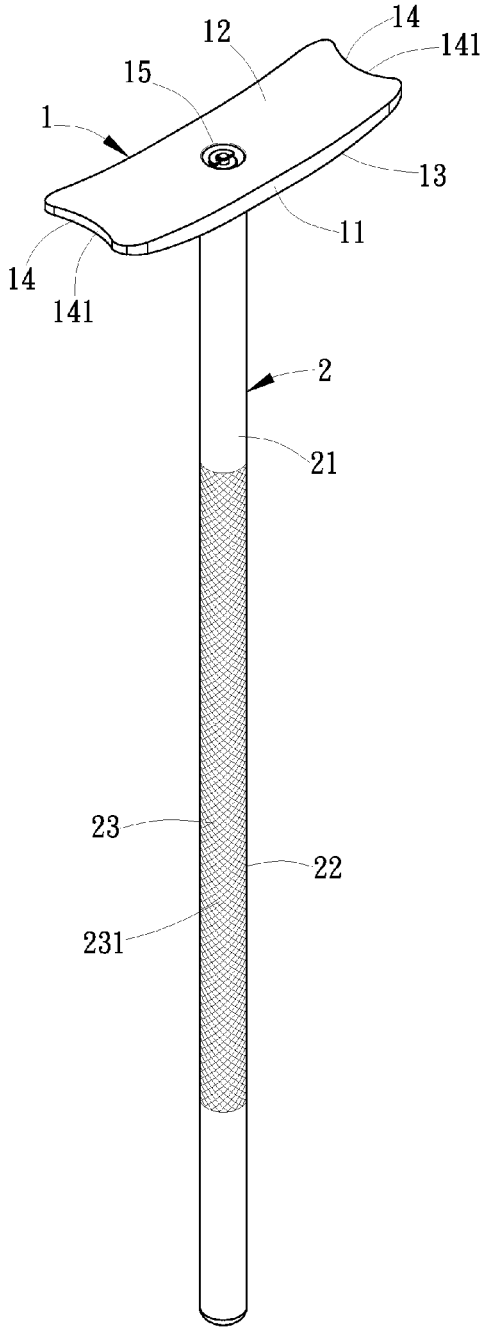
FIG. 1 is a perspective view of a golf swing/putting trainer in accordance with the present invention.
Figure 2:
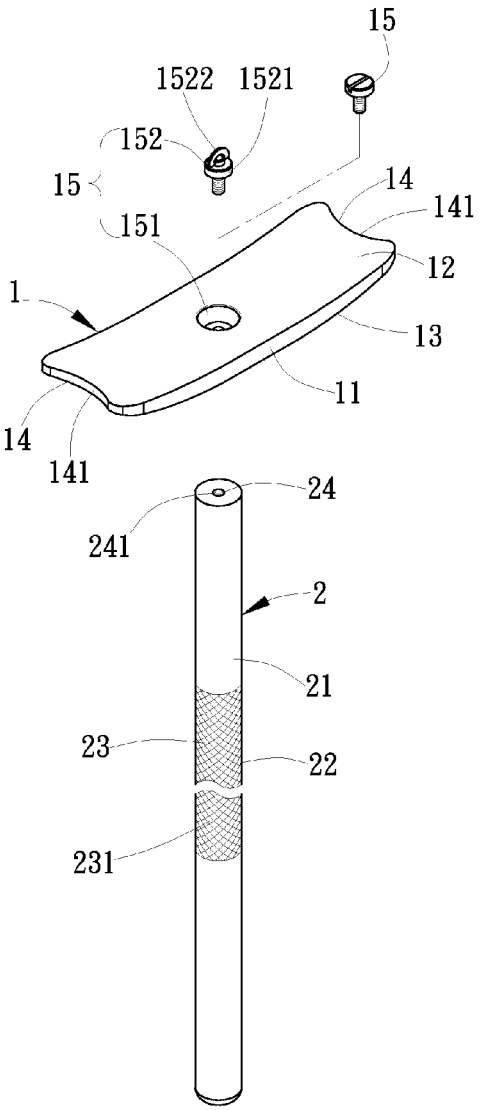
FIG. 2 is an exploded view of the golf swing/putting trainer in accordance with the present invention.

Referring to FIG. 1 and FIG. 2, a golf swing/putting trainer in accordance with the present invention is shown. The golf swing/putting trainer is adapted to help the user practice the actions of backswing, swing and putting, especially for training the user to twist the waist and to swing the arms. The golf swing/putting trainer comprises a support member 1, and a handle 2 connected to the support member 1.

The support member 1 comprises a body 11 made of plastics or metal in the shape of a plate. However, the plate-like configuration is meant to be an illustration and not a limitation. In another embodiment of the present invention, the body of the support member is shaped like a bar. Preferably, the body 11 is shaped like an arched plate, shaft or bar, comprising a supporting wall 12 located at one side thereof for stopping against the user's abdomen, and a mounting wall 13 located on an opposite side thereof. The supporting wall 12 curves inwardly and smoothly for stopping against the user's abdomen. The body 11 of the support member 1 further comprises a bearing portion 14 located at each of two opposite ends thereof. The bearing portion 14 is preferably an inwardly curved bearing edge 141. The curvature of the inwardly curved bearing edge 141 fits the curvature of the cross section of the human being's lower arm.

The handle 2 comprises a shaft 21 of circular cross section or any other desired shape. The shaft 21 comprises a handhold portion 22 for the holding of the user's two hands. One end of the shaft 21 is fastened to the center of the mounting wall 13 of the body 11 of the support member 1. To prohibit the handle 2 from slipping out of the user's hands, the handhold portion 22 is configured to provide an anti-slip structure 23. The anti-slip structure 23 can be a design of anti-slip grains 231, or an anti-slip sleeve.

Figure 3:
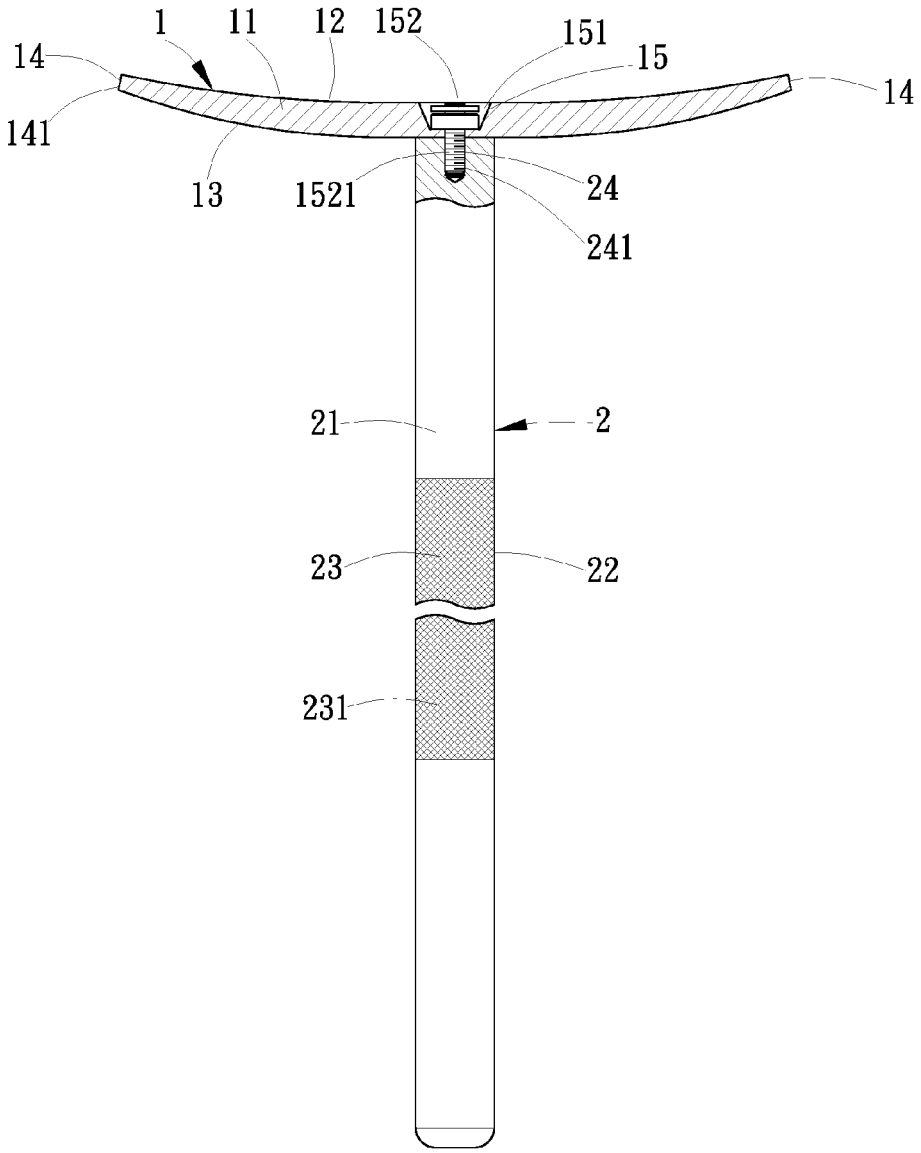
FIG. 3 is a schematic front view of the golf swing/putting trainer in accordance with the present invention.
Figure 4:
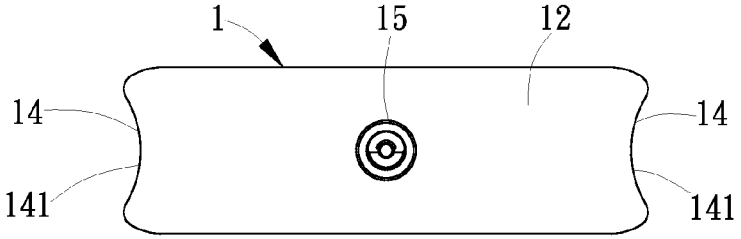
FIG. 4 is a schematic top view of the golf swing/putting trainer in accordance with the present invention.

Referring to FIGS. 3 and 4 and FIG. 2 again, the support member 1 further comprises a first connection device 15 located at the center of the body 11. The handle 2 comprises a second connection device 24 located at one end (the top end) thereof and connected to the first connection device 15 of the support member 1. In this embodiment, the first connection device 15 comprises a countersunk hole 151 connected between the supporting wall 12 and the mounting wall 13, and a fastening member 152 mounted in the countersunk hole 151. The fastening member 152 can be a regular screw or wing screw. In the form of a wing screw, the fastening member 152 comprises a screw body 1521, and a swivel wing 1522 pivotally mounted at one end of the screw body 1521. The swivel wing 1522 can be biased relative to the screw body 1521 between an operative vertical position and a non-operative horizontal position. When set in the non-operative horizontal position, the swivel wing 1522 can be received in the countersunk hole 151. The second connection device 24 of the handle 2 is a locating hole, for example, a screw hole 241 mating the fastening member 152. Thus, the handle 2 can be detachably connected to the center of the support member 1. When not in use, the handle 2 can be detached from the support member 1 to reduce the dimension of the golf swing/putting trainer for carrying.

Figure 5:
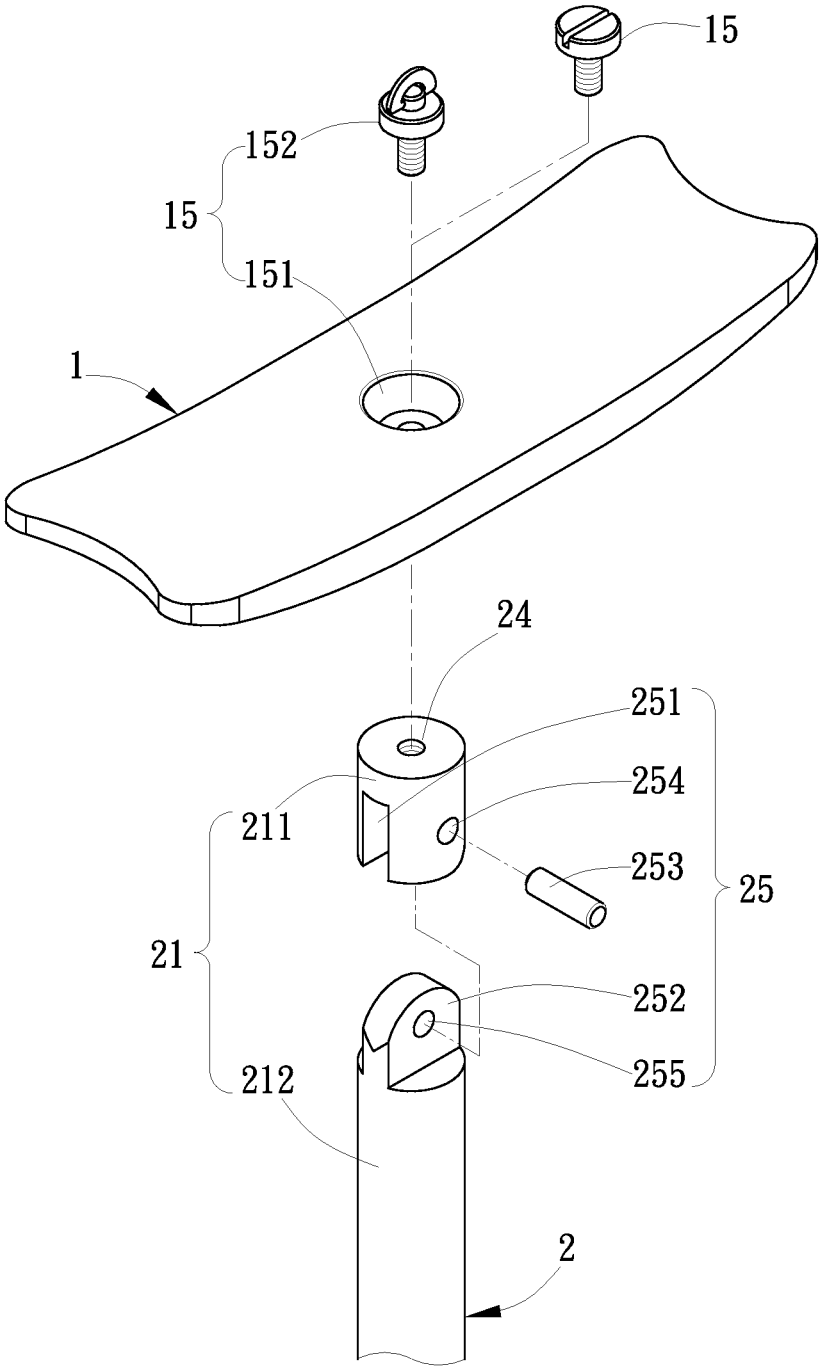
FIG. 5 is a schematic exploded view of an alternate form of the golf swing/putting trainer in accordance with the present invention.
Figure 6:
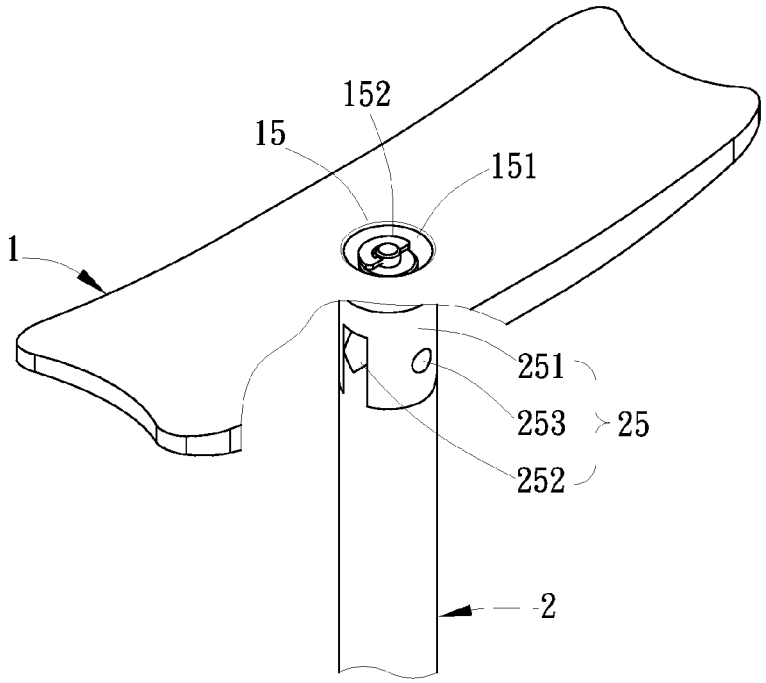
FIG. 6 is a schematic assembly view of the alternate form of the golf swing/putting trainer shown in FIG. 5.

Referring to FIGS. 5 and 6, in an alternate form of the present invention, the handle 2 is collapsible without dismounting the fastening member 152. According to this alternate form, the shaft 21 comprises a first shaft member 211, a second shaft member 212, and a joint 25 connected between the first shaft member 211 and the second shaft member 212. The joint 25 comprises a coupling slot 251 located in one end of the first shaft member 211, a coupling flange 252 located at one end of the second shaft member 212 and insertable into the coupling slot 251, a first pivot hole 254 transversely located in the first shaft member 211 across the coupling slot 251, a second pivot hole 255 transversely located in the coupling flange 252, and a pivot member 253, for example, a pivot pin, screw or wing screw fastened to the first pivot hole 254 and the second pivot hole 255 to pivotally connect the first shaft member 211 and the second shaft member 212. Thus, when not in use, the handle 2 can be collapsed and closely attached to the support member 1 (see FIG. 7).

Figure 8:
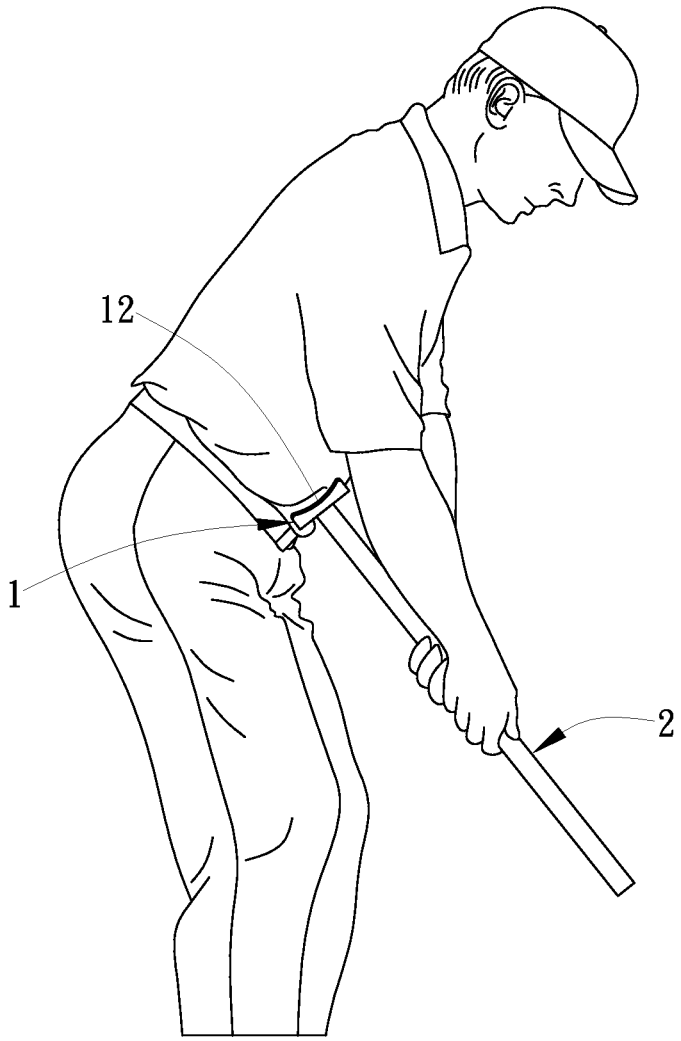
FIG. 8 is a schematic applied view of the golf swing/putting trainer in accordance with the present invention, illustrating a swing training operation (I).
Figure 9:
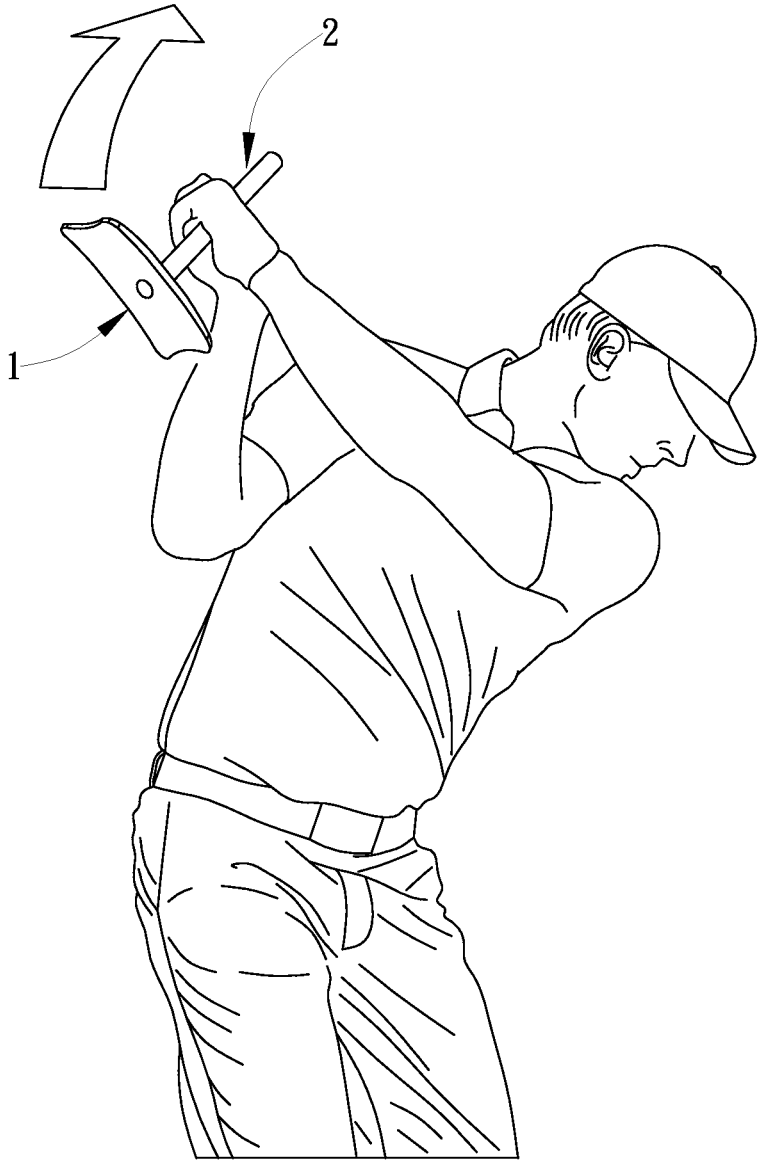
FIG. 9 is a schematic applied view of the golf swing/putting trainer in accordance with the present invention, illustrating a swing training operation (II).

Referring to FIGS. 8 and 9, when practicing the swing action, the user holds the handhold portion 22 of the handle 2 with the two hands, and then attaches the supporting wall 12 of the body 11 of the support member 1 to the user's abdomen, and then swing the hands to practice golf driving. Thus, the user can use the golf swing/putting trainer to practice golf driving anywhere anytime. By repeatedly training the waist and the arms to practice swinging and back-swinging, the user can keep the optimal posture and movement in the actual swing play.

Figure 7:
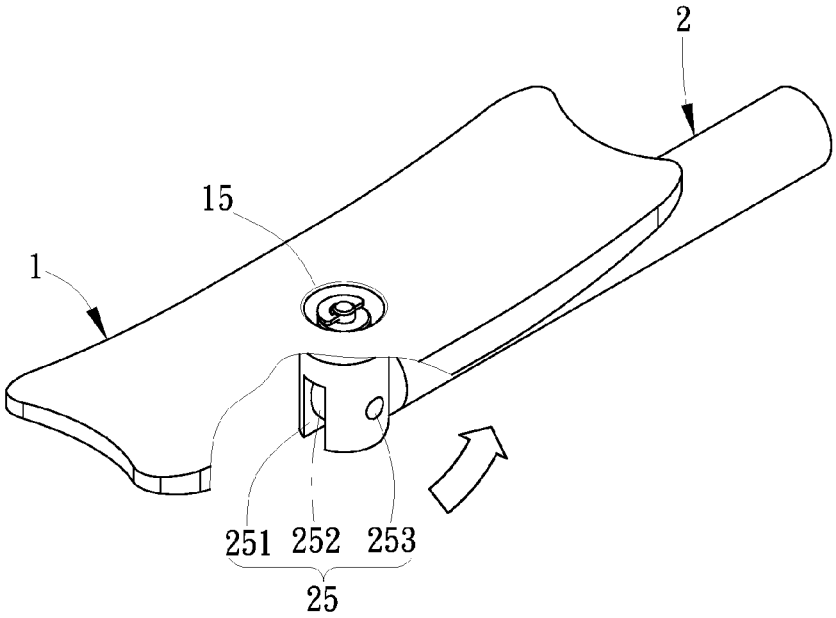
FIG. 7 corresponds to FIG. 6, illustrating the handle collapsed.
Figure 10:
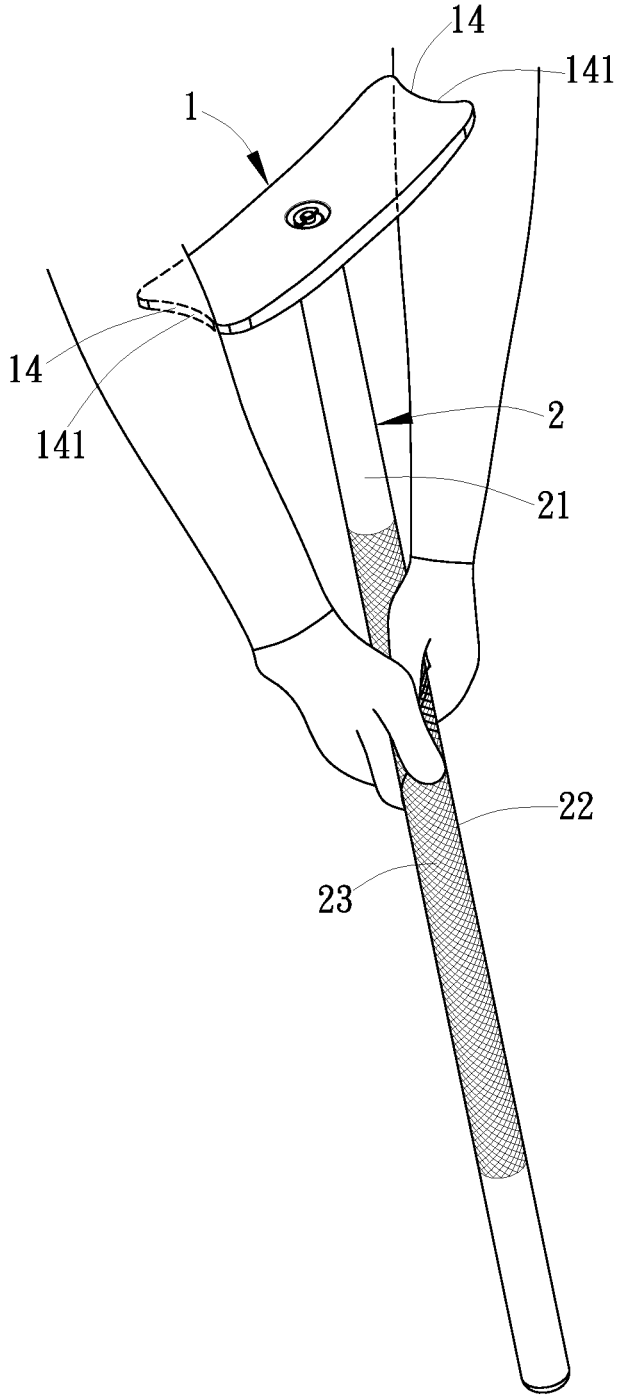
FIG. 10 is a schematic applied view of the golf swing/putting trainer in accordance with the present invention, illustrating a putting training operation (I).
Figure 11:
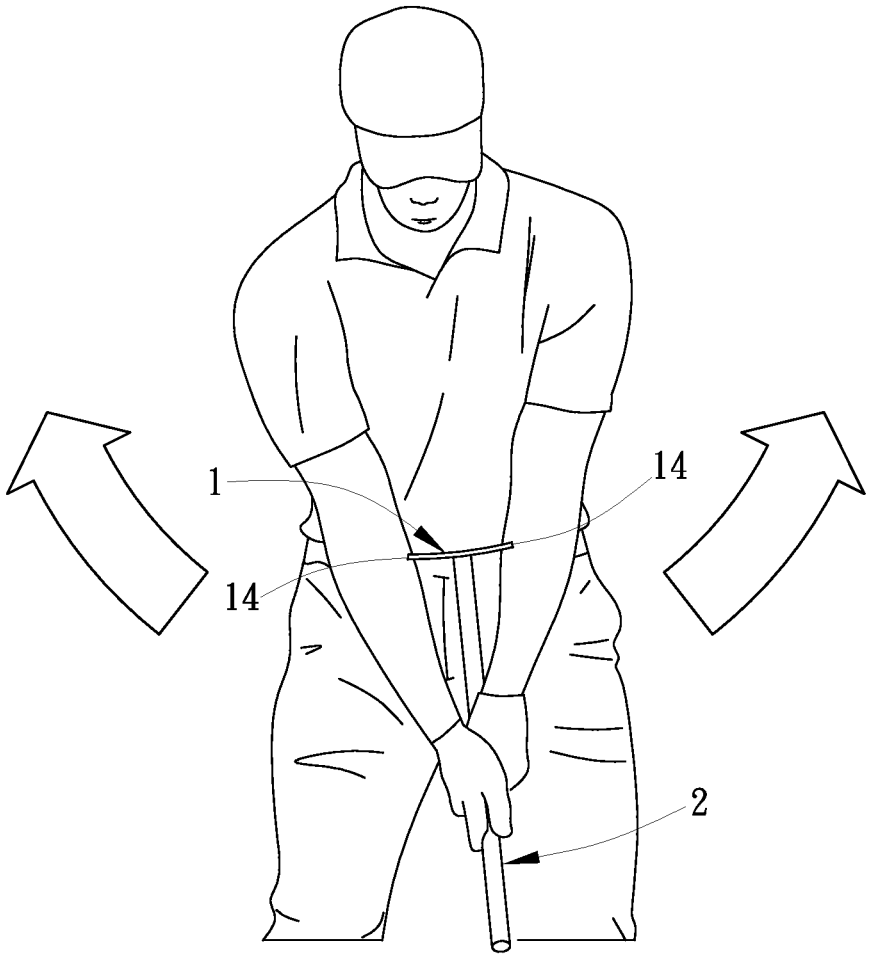
FIG. 11 is a schematic applied view of the golf swing/putting trainer in accordance with the present invention, illustrating a putting training operation (II).

Referring to FIGS. 10 and 11, when practicing the putting action, the user holds the handhold portion 22 of the handle 2 with the two hands, and then attaches the two lower arms to the inwardly curved bearing edges 141 of the two bearing portions 14 of the support member 1. Thus, the two arms can be kept stable in the accurate posture when practicing the putting action. By repeatedly training the arms to practice the putting action, the user can keep the optimal posture and movement in the actual putting play. Further, when not in use, the support member 1 and the handle 2 can be detached from each other (or collapsed as shown in FIG. 7 for the alternate embodiment) to facilitate carrying.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A golf swing/putting trainer, comprising:

a support member comprising a body in a plate shape, said body comprising a supporting wall for stopping against the user's body; and a handle comprising a shaft, said shaft comprising a handhold portion for holding by the user's both hands, said shaft having one end thereof connected to a center part of said body of said support member, wherein said support member comprises a countersunk hole in the center part of said body of said support member and a fastening member mounted in said countersunk hole; and said handle comprises a locating hole at said one end of said shaft fastened to said fastening member.

2. The golf swing/putting trainer as claimed in claim 1, wherein said body of said support member comprises two bearing portions respectively located at two opposite ends thereof for stopping against the user's arms.

3. The golf swing/putting trainer as claimed in claim 2, wherein each said bearing portion is an inwardly curved bearing edge located at one of the two opposite ends of said body of said support member.

4. The golf swing/putting trainer as claimed in claim 1, wherein said fastening member is a screw; and said locating hole is a screw hole.

5. The golf swing/putting trainer as claimed in claim 1, wherein said handhold portion comprises an anti-slip structure.

6. The golf swing/putting trainer as claimed in claim 5, wherein said anti-slip structure is a design of anti-slip grains located at a surface of said shaft.

7. The golf swing/putting trainer as claimed in claim 1, wherein said handle comprises a first shaft member, a second shaft member, and a joint connected between said first shaft member and said second shaft member.

8. The golf swing/putting trainer as claimed in claim 7, wherein said joint comprises a coupling slot located in said first shaft member, a coupling flange located at said second shaft member and inserted into said coupling slot, and a pivot member inserted through said coupling slot and said coupling flange to pivotally connect said first shaft member and said second shaft member together.

9. A golf swing/putting trainer, comprising:

a support member comprising a body in a plate shape, said body comprising a supporting wall for stopping against the user's body; and a handle comprising a shaft, said shaft comprising a handhold portion for holding by the user's both hands, said shaft having one end thereof connected to a center part of said body of said support member, wherein said handle comprises a first shaft member, a second shaft member, and a joint connected between said first shaft member and said second shaft member; wherein said joint comprises a coupling slot located in said first shaft member, a coupling flange located at said second shaft member and inserted into said coupling slot, and a pivot member inserted through said coupling slot and said coupling flange to pivotally connect said first shaft member and said second shaft member together.

10. The golf swing/putting trainer as claimed in claim 9, wherein said body of said support member comprises two bearing portions respectively located at two opposite ends thereof for stopping against the user's arms.

11. The golf swing/putting trainer as claimed in claim 10, wherein each said bearing portion is an inwardly curved bearing edge located at one of the two opposite ends of said body of said support member.

12. The golf swing/putting trainer as claimed in claim 9, wherein said handhold portion comprises an anti-slip structure.

13. The golf swing/putting trainer as claimed in claim 12, wherein said anti-slip structure is a design of anti-slip grains located at a surface of said shaft.

* * * * *